United States Patent [19]

Bluhm et al.

[11] Patent Number: 5,071,513

[45] Date of Patent: Dec. 10, 1991

[54] METHOD FOR THE MECHANICAL-THERMAL DEWATERING OF A FIBER STOCK WEB

[75] Inventors: Reinhard Bluhm, Berg; Herbert Holik, Ravensburg; Peter Mirsberger, Berg, all of Fed. Rep. of Germany

[73] Assignee: Sulzer-Escher Wyss GMBH, Ravensburg, Fed. Rep. of Germany

[21] Appl. No.: 469,071

[22] Filed: Jan. 23, 1990

Related U.S. Application Data

[63] Continuation-in-part of Ser. No. 135,322, Dec. 21, 1987, abandoned.

[30] Foreign Application Priority Data

Dec. 24, 1986 [CH] Switzerland ..... 05152/86

[51] Int. Cl.[5] ..... D21F 3/06; D21F 5/00

[52] U.S. Cl. ..... 162/206; 34/16; 34/111; 100/38; 100/93 R; 162/359; 162/360.1

[58] Field of Search ..... 162/205, 206, 207, 290, 162/358, 359, 360.1, 375; 100/38, 93 R, 93 P, 93 RP, 118, 153, 154; 34/7, 16, 111, 116, 123

[56] References Cited

U.S. PATENT DOCUMENTS

| | | | |
|---|---|---|---|
| 2,907,690 | 10/1959 | Hornbostel et al. | 162/206 |
| 3,354,035 | 11/1967 | Gottewald et al. | 162/206 |
| 3,970,515 | 7/1976 | Busker | 162/205 |
| 4,464,226 | 8/1984 | Karrinen | 162/358 |
| 4,468,287 | 8/1984 | Dahl | 162/358 |
| 4,506,456 | 3/1985 | Lehtiner | 34/41 |
| 4,506,457 | 3/1985 | Lehtiner | 34/41 |
| 4,556,454 | 12/1985 | Dahl et al. | 162/358 |
| 4,568,423 | 2/1986 | Laapotti | 162/358 |
| 4,570,314 | 2/1986 | Holik et al. | 29/113.1 |
| 4,576,682 | 3/1986 | Laapotti | 162/358 |
| 4,661,206 | 3/1987 | Heitmann et al. | 162/358 |
| 4,738,752 | 4/1988 | Busker et al. | 162/359 |

FOREIGN PATENT DOCUMENTS

| | | |
|---|---|---|
| 3336462 | 4/1984 | Fed. Rep. of Germany . |
| PCT8503314 | 8/1985 | PCT Int'l Appl. . |

OTHER PUBLICATIONS

Wochenblatt Fur Papierfabrication 1-1987, Article by P. Mirsberger entitled "Ergenbnesse Mit Intensa--Pressen", pp. 7 to 13.

Pulp & Paper Canada 85:7 (1984)-Article by M. N. Radwan et al.-entitled "Application of Hot Pressing on Domtar Paper Machines", pp. 38-42.

Tappi Journal, vol. 66, No. 9-Article by Sven Arenandar et al.-entitled "Impulse Drying Adds New Dimension to Water Removal", pp. 123-126, Sep. 1983.

*Primary Examiner*—Karen M. Hastings

*Attorney, Agent, or Firm*—Sandler, Greenblum & Bernstein

[57] ABSTRACT

At least two substantially parallel rows of adjustable pressure elements cooperate with a heatable counter element like a counter roll and are arranged immediately consecutive but separate from each other to define at least two pressing sections of an extended pressing zone through which a water-containing fibrous web is passed conjointly with a water absorbing porous band or felt in a predeterminate travel direction. Pressures and temperatures in each one of the at least two pressing sections of the extended pressing zone are adjusted such that water is displaced from the fibrous web under the combined action of pressure and steam which is formed in the extended pressing zone in a controlled manner and without damage to the fibrous web due to explosion-like flash evaporation.

17 Claims, 5 Drawing Sheets

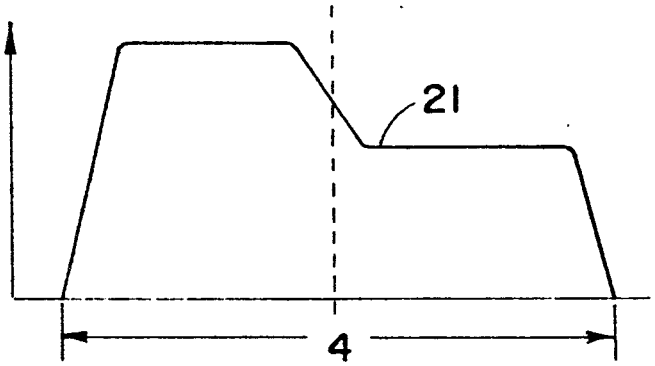
Fig - 1A
Fig - 1
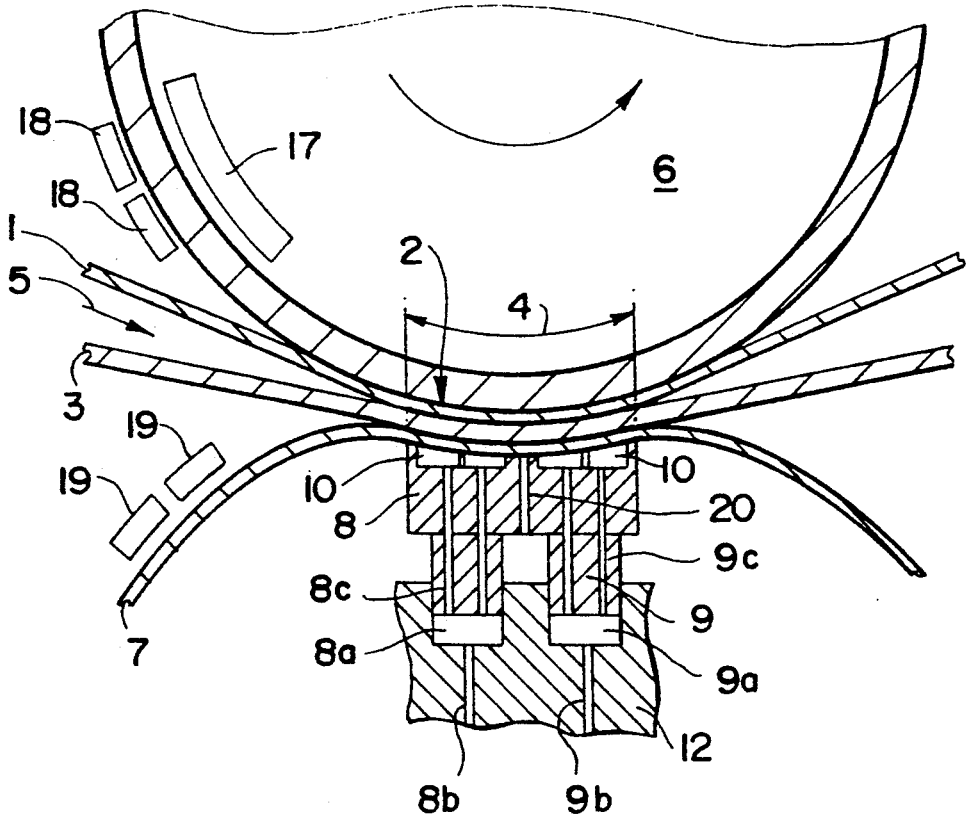

Fig - 2A
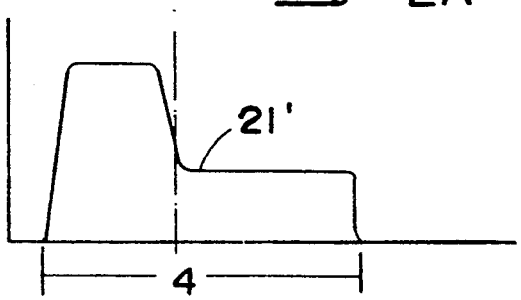
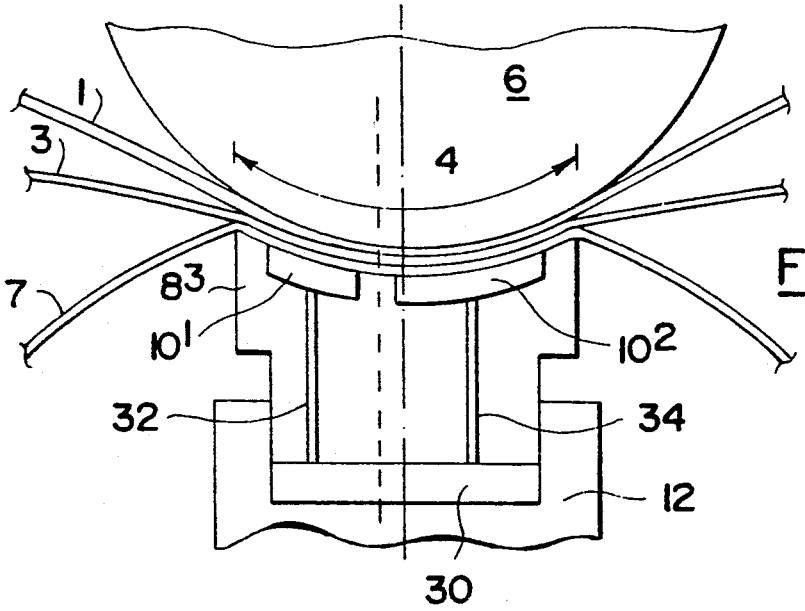
Fig - 2

METHOD FOR THE MECHANICAL-THERMAL DEWATERING OF A FIBER STOCK WEB

CROSS REFERENCE TO RELATED APPLICATIONS

This application is a continuation-in-part of the commonly assigned, copending U.S. application Ser. No. 07/135,322, filed Dec. 21, 1987, now abandoned and entitled "METHOD AND APPARATUS FOR THE MECHANICAL-THERMAL DEWATERING OF A FIBER STOCK WEB".

BACKGROUND OF THE INVENTION

The present invention relates to a new and improved method of, and apparatus for, the mechanical-thermal dewatering of a water-containing fibrous or fiber web, especially although not exclusively, a paper web.

Generally speaking, in the practice of the invention for the dewatering of the fibrous web there is simultaneously utilized pressure and thermal energy in a nip through which there is guided the fibrous web to be dewatered in conjunction with a suitable porous band, such as typically a felt, for the absorption of the expressed water released from the fibrous web. The application of thermal energy or heat advantageously increases the quantity of water which can be displaced from the fibrous or fiber web and taken up or absorbed at the porous band.

Such dewatering operations are utilized, by way of example, in paper making machines at the press or pressing section or at a region subsequent thereto viewed with respect to the direction of travel of the fibrous web. There are already known in such technology different constructions of the press or pressing section wherein there is employed thermal energy at the region of the nip.

In U.S. Pat. No. 3,354,035, granted Nov. 21, 1967, there is disclosed for instance the possibility of bringing a moist paper web into contact with a heated cylinder. The paper web is maintained in contact with the cylinder surface at temperatures up to 200° C. by means of a pervious pressing band. In such document there is mentioned the advantage that the water within the paper web can be entrained into the felt by the formed water vapor or steam. This water vapor or steam augments the transfer of the water out of the paper web. There is mentioned therein the danger of damage to the paper web by virtue of the press rolls which are considerably heated.

On the other hand, when utilizing bands or belts as the pressing or contact elements, by virtue of the low-contact pressure the augmenting thermal action is not completely effective, so that the dewatering of the paper web is not particularly efficacious.

In U.S. Pat. No. 4,324,613, granted Apr. 13, 1982, it is proposed to obtain the requisite extremely high thermal energy density or flow rates by externally heating a cylinder by means of a gas burner. During arrival of the paper web in a nip formed with a suction roll there is produced water vapor or stream which displaces the free surface water out of the paper web into a felt which is then withdrawn over the suction roll. The paper web is trained about the heated cylinder and is scraped away therefrom. The preferred utilization of this method resides in fabrication of paper of very low weight.

In PCT-International Published Application No. WO 85/03314, published Aug. 1, 1985, a moist paper web is pressed by means of a pressing felt heated to a temperature exceeding 100° C. against a drying cylinder. The water which has been pressed into the felt is subsequently sucked out of the felt in conjunction with the condensed water vapor or steam. The produced water vapor in the pressing nip is supposed to simultaneously constitute a barrier against the re-wetting of the paper web. The required heating of the felt by means of a burner appears to be not without considerable danger and, as expected, the water vapor or steam exploding behind the press nip can cause damage of the outbound or outgoing paper web.

In the Tappi Journal, Volume 66, No. 9, September 1983 issue, pages 123 to 126, there is described a dewatering press working with a heated roll press nip. Experiments with a press simulator demonstrated that with a heated press surface there can be attained an appreciable increase in the drying action in contrast to pure mechanical dewatering. This action, referred to in the art as "Impulse Drying" is explained in terms of the water vapor or steam which is produced in the press nip and which entrains the water out of the capillaries in the press felt. Also according to the information contained in this document there would be expected damage to the paper web during its exit out of the press nip by virtue of the sudden and uncontrolled expansion of the existing water vapor or steam in the paper web.

In a dewatering apparatus as known from U.S. Pat. No. 4,738,752, granted Apr. 19, 1988, a fibrous web to be dewatered is fed through an extended nip formed between a press member, for example, a press roll and a press shoe. The fibrous web is exposed to pressure . generated by the press shoe with the interposition of blanket means and heat is transferred to the fibrous web, for example, by heating means such as induction heaters which heat the roll surface of the press roll outside of the extended nip. Instead, the press roll may be provided with internal bores for throughpassing a heat carrier or with an externally heated heat transfer band which is passed through the extended nip conjointly with the fibrous web. Furthermore, a water absorbing web like a felt web is passed through the extended nip conjointly with the fibrous web. In a further modification, preheating means are provided for preheating, for instance, the fibrous web prior to its entry into the extended nip.

In this construction, the press shoe has a configuration which permits exposing the fibrous web to different pressure conditions while the fibrous web is passed through the extended nip in contact with the preheated press roll or heat transfer band. During the passage through the extended nip and after first passing through a thermally-augmented wet pressing phase, a large proportion of liquid water which is contained in the fibrous web, is displaced therefrom under the action of water vapor or steam which is generated under the prevailing pressure and temperature conditions. Following the second phase, the fibrous web is subjected to pressurized flash drying during a third phase of the drying operation and to unpressurized flash drying during a fourth phase of the drying operation upon exit of the fibrous web from the pressing section.

One or more pressure shoes can be arranged in juxtaposition at the press roll. If a multiple number of press shoes is employed, the individual shoes are spaced from each other. In the intermediate space, the felt web may be separated from the fibrous web in order to prevent rewetting thereof. Also, additional heating means may be provided in the intermediate space between two press shoes.

With the heretofore employed dewatering methods it has not been possible to obtain the advantages and effects for the dewatering operation which were to be expected by virtue of the simultaneous employment of pressure and temperature in the pressing nip, sometimes simply referred to herein as nip. In particular, it has proven disadvantageous that pressure decreases for flash drying may result in "explosive" evaporation resulting in damage to the web and the temperature is difficult to control and adjust due to the heat transfer along the press nip and because the thermal energy is supplied outside, specifically precedingly or upstream of the press nip as viewed in the travel direction through the press nip.

SUMMARY OF THE INVENTION

Therefore with the foregoing in mind it is a primary object of the present invention to provide a new and improved method of, and apparatus for, the mechanical-thermal dewatering of a fibrous web, especially although not exclusively, a paper web, which does not suffer from the aforementioned drawbacks and shortcomings of the prior art constructions.

Another and more specific object of the present invention aims at providing a new and improved method of, and apparatus for, dewatering a fibrous web in a manner such that there can be enhanced or increased the dewatering action due to the simultaneous employment of pressure and thermal energy in the press nip, and at the same time there is eliminated or at least appreciably suppressed the danger of damage to the fibrous web during its treatment in the press nip and during its exit therefrom to the region where there prevails ambient pressure.

Another important object of the present invention is directed to providing a new and improved method of, and apparatus for, dewatering a fibrous web in at least two sections of an extended pressing zone under the combined action of pressure and heat in a manner such that web-damaging flash evaporations are successfully suppressed during the time the fibrous web passes through and issues from the extended pressing zone.

Yet a further significant object of the present invention aims at the provision of a new and improved method of, and apparatus for, the mechanical-thermal dewatering of a fibrous web in an extremely efficient, reliable and protective manner.

Still a further significant object of the present invention is concerned with a new and improved method of, and apparatus for, mechanical-thermal dewatering of a fibrous web, especially a paper web, in an efficient manner through the employment of pressure and temperature applied such as to maximize the removal of water from the fibrous web regardless of the type and water or moisture content of the fibrous web subjected to the dewatering operation.

Now in order to implement these and still further objects of the invention, which will become more readily apparent as the description proceeds, the method of the present development contemplates passing a water-containing fibrous web to be dewatered together with a porous band for taking up water which is displaced from the fibrous web, in a predetermined travel direction through an extended pressing zone. At least two substantially parallel rows of individually, for instance, hydraulically adjustable pressure elements are arranged immediately consecutive but in sealed relationship to each other as viewed in the travel direction of the fibrous web and cooperate with a counter roll to form at least two immediately consecutive but separate sections of the extended pressing zone. The counter roll is heated and the heated counter roll is contacted with the fibrous web during its passage through the extended pressing zone whereby predeterminate temperature conditions are established in the at least two immediately consecutive but separate sections of the extended pressing zone. In at least one of the at least two sections of the extended pressing zone, the pressure applied to the fibrous web is selected such as to be at least sufficient to substantially completely saturate voids, pores and capillaries of the fibrous web with liquid water contained therein. The pressure is further adjusted such as to build-up hydraulic pressure in the fibrous web so that a first portion of liquid water is displaced from the fibrous web in the porous band under the action of the total pressure exerted upon the fibrous web. In a further one of the at least two immediately consecutive but separate sections of the extended pressing zone, the pressure and temperature conditions are selected such that there is substantially zero hydraulic pressure acting upon the fibrous web and the prevailing pressure is lower than the equilibrium vapor pressure of the water contained in the fibrous web. As a consequence, part of the water vaporizes under the temperature conditions prevailing in the further section of the extended pressing zone and the thus produced steam displaces a second portion of water from the fibrous web into the porous band.

When carrying out the inventive method, the pressure and temperature conditions during passage of the fibrous web through the extended pressing zone are selected such that at least substantially all of the liquid water which is present in the fibrous web, is displaced from the fibrous web prior to reduction of the pressure to ambient pressure in order to thereby prevent web-damaging flash evaporation of liquid water as a result of the pressure reduction under the prevailing temperature conditions.

The invention is based on the recognition that the combined action of pressure and heat during the dewatering operation requires that certain pressure and temperature conditions must be met. Thus, for instance, drops or pockets of liquid water should be substantially completely removed by displacement and evaporation from the fibrous web during its passage through the extended pressing zone because such drops or pockets of liquid water may be subject to flash or explosive evaporation under the temperature conditions of sudden pressure relief to, for example, ambient pressure upon exit of such fibrous web from the pressing zone. Such flash or explosive evaporation of drops or pockets of liquid water which are contained in the interior of the fibrous web, not only result in density irregularities of the dried fibrous web but may also severely damage the fibrous web due to the abrupt volume increase which accompanies such flash or explosive evaporation. In order to avoid such detrimental effects, it is essentially that substantially all of the liquid water is displaced from the fibrous web during its passage through the extended pressing zone. The inventive method and apparatus ensure that the prevailing pressure and temperature conditions can be selected such that this objective is reliably accomplished.

When carrying out the inventive method, therefore, the fibrous web is compressed in a first one of the at least two immediately consecutive but separate sections of the extended pressing zone to such extent that the voids, pores and capillaries of the fibrous web are substantially completely filled or saturated by the liquid water which is contained in the fibrous web. Only then, the passageways through the fibrous web are sufficiently blocked to ensure that, in the further or following one of the at least two sections of the extended pressing zone evaporation of water, i.e. the formation of steam under the action of reduced pressure and heat and the concomitant volume increase will lead to displacement of substantially all of the remaining liquid water from the fibrous web into the porous band or water absorbing web which is in contact with the fibrous web. By the judicious choice of the pressure and temperature conditions prevailing in the consecutive different sections of the extended pressing zone, a substantial amount of water which does not form a coherent liquid phase but, for example, may be adhered to the fibers of the fibrous web, can be additionally removed by evaporation without damage to the fibrous web.

The fibrous web is travelling at relatively high speed through the extended pressing zone in which heat is transferred from the press roll or counter roll cooperating with the at least two rows of pressure elements, to the travelling fibrous web. Therefore, the extended pressing zone must have a sufficient length for permitting the various stages of the dewatering processes to run substantially to completion during the relatively short time which is available for dewatering the fibrous web during its passage through the extended pressing zone. Due to the formation of the extended pressing zone from at least two rows of pressure elements and which rows are arranged immediately consecutive but in sealed relationship to each other as viewed in the travel direction of the fibrous web, there is ensured that enough time is available for carrying out the overall dewatering process. The effective conditions of pressure and water or moisture content of the momentarily processed fibrous web as well as to the type of fibrous web which is momentarily processed.

In one exemplary embodiment of the inventive method, the extended pressing zone is subdivided into two sections. When utilizing such construction, the pressure and temperature conditions in the first section as viewed in the travel direction of the fibrous web, can be selected such that the hydraulic pressure prevailing in the first section is higher than the equilibrium vapor pressure of the water contained in the fibrous web under the prevailing temperature conditions. A first portion of water is, then, merely squeezed out of the fibrous web into the porous band. In the following second section of the extended pressing zone, the pressure and temperature conditions are selected or adjusted such that the hydraulic pressure is practically zero and the pressure is higher than ambient pressure but lower than the equilibrium vapor pressure of water under the temperature conditions prevailing in the second section. Under these conditions, water vapor or steam is formed where the counter roll contacts the fibrous web and such water vapor or steam formation is sufficient to expel or displace substantially the remaining or second portion of liquid water from the fibrous web. In this manner, the fibrous web is relieved from the hydraulic pressure in the second section of the extended pressing zone so that the fibrous web can expand to a certain extent and does not exit from the extended pressing zone in an undesirable over-compressed state. Furthermore, the pressure and temperature conditions in the second section of the extended pressing zone can be selected or adjusted such that also at least part of the water which adheres to the fibers of the fibrous web, is also evaporated and displaced or transported into the porous band if the temperature in the fibrous web is sufficiently high and condensation of the water vapor or steam within the fibrous web can be avoided. This beneficial effect is further enhanced when the fibrous web exits from the extended pressing zone and the pressure is further reduced to ambient pressure.

During passage through the extended pressing zone, the counter roll transfers or loses heat to the through-passing fibrous web and other components of the dewatering apparatus. Under certain conditions, the heat loss may assume such extent that the temperatures are insufficient for the desired evaporation in the second section of the extended pressing zone. Therefore, in a preferred embodiment of the inventive method, the counter roll is heated particularly, for example, by employing inductive heating in the region of the extended pressing zone. Specifically, the counter roll may be inductively heated, for example, in the transition region between the first section and the second section or in the end region of the first section as viewed in the travel direction of the web.

In the presence of such additional heating, further modifications of the inventive method are possible. Thus, for example, the pressure prevailing in the first section of the extended pressing zone may be adjusted or selected such that, under the prevailing temperature conditions, already part of the water contained in the fibrous web is vaporized in such first section so that a greater amount of water is displaced as the first portion of water from the fibrous web into the porous band in the first section of the extended pressing zone. The heat which is lost due to vaporization of water as well as the amounts of heat which are lost by heat conduction to the fibrous web and the other components of the dewatering apparatus, is partially or wholly replaced by inductively heating the counter roll in the end region of the first section. Consequently, the fibrous web enters the second section of the extended pressing zone at relatively high temperatures. The pressure which is selected or adjusted in this second section, however, must be significantly increased in order to eliminate the voids, pores and capillaries which are formed in the fibrous web during its passage through the first section due to the vaporization of water contained in the fibrous web. However, the temperature in the second section is sufficiently high so that the increased pressure prevailing in this second section is still below the equilibrium vapor pressure of the water contained in the fibrous web so that also under these conditions the desired extent of dewatering can be obtained.

In a further development of the inventive method the comparatively high pressure drop upon exit of the dried fiber web from the second section of the extended pressing zone, can be counteracted by adding a third row of pressure elements which are arranged substantially parallel to the aforementioned two rows of pressure elements and immediately consecutive but in sealed relationship to each other. Preferably, the pressure prevailing in this third section of the extended pressing zone is selected or adjusted such as to be considerably lower than the pressure prevailing in the second section of the extended pressing zone but still above ambient pressure.

In order to avoid uncontrolled expansion of the fibrous web upon its exit from the extended pressing zone, it may be preferable to reduce the pressure in the end region of the second section or third section, as the case may be, to ambient pressure. This has the beneficial effect that the expansion of the fibrous web as a result of the pressure relief is limited by the space available in the end region of the extended pressing zone.

The parallel rows of pressure elements, as already explained hereinbefore, are arranged immediately consecutive but in sealed relationship to each other. In fact, the arrangement is such that, on the one hand, there is no communication between the individual consecutive rows of pressure elements. This has the highly desirable consequence that the pressures which prevail in the consecutive sections of the extended pressing zone, can be separately adjusted independently of each other and that there is still accomplished a continuous transition of the fibrous web from one section to the next-following section of the extended pressing zone. The fibrous web thus is not required to travel through intermediate spacings in which it is exposed to ambient pressure between different sections of the extended pressing nip zone. The parallel rows of pressure elements also permit providing an extended pressing zone of a sufficient length for exposing the fibrous web to different dewatering conditions during its travel through the extended pressing zone.

As alluded to above, the invention is not only concerned with the aforementioned method aspects, but also deals with an improved apparatus for the mechanical-thermal dewatering of a fibrous or fiber web, especially a paper web, due to the simultaneous application of pressure and heat in an extended pressing zone. This extended pressing zone is formed between coacting members, such as a heated counter roll having a solid or full surface and an impervious band or band member. The impervious band presses the fibrous web in the direction of the counter roll by means of pressing or pressure elements arranged in a predetermined number of substantially parallel rows which define discrete, i.e. immediately consecutive but separate sections or regions of the extended pressing zone as viewed in a predetermined direction of travel of the fibrous or paper web through the extended pressing zone. These pressing or pressure elements allow uninterrupted transition of the fibrous web from one discrete section or region to the next-following section or region of the extended pressing zone and independent selection or adjustment of different pressure and temperature conditions in the different consecutive sections or regions of the extended pressing zone.

In the context of this disclosure it is to be understood that the term "impervious band" or equivalent terminology are used in a broader sense as not only encompassing an impervious band or belt as such, but also should be understood as embracing other types of structures such as impervious shells or jacket members or the like by means of which there can be formed an extended nip as is well known in this technology.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 illustrates in fragmentary sectional view a first exemplary embodiment of the apparatus for mechanical-thermal dewatering of a fibrous web or the like and useful for practicing a first exemplary embodiment of the method of the present development;

FIG. 1A illustrates the associated pressure profile or curve along the extended pressing zone of the dewatering apparatus depicted in FIG. 1;

FIG. 2 illustrates a second exemplary embodiment of the inventive dewatering apparatus;

FIG. 2A illustrates the associated pressure profile or curve along the extended pressing zone of the dewatering apparatus as shown in FIG. 2;

FIG. 5 illustrates a fragmentary sectional view of a fifth exemplary embodiment of the inventive apparatus for mechanical-thermal dewatering of a water-containing fibrous web or the like;

FIG. 6 illustrates a fragmentary sectional view of a sixth exemplary embodiment of the inventive apparatus for mechanical-thermal dewatering of a water containing fibrous web or the like.

DETAILED DESCRIPTION OF THE PREFERRED EMBODIMENTS

Figure 3:
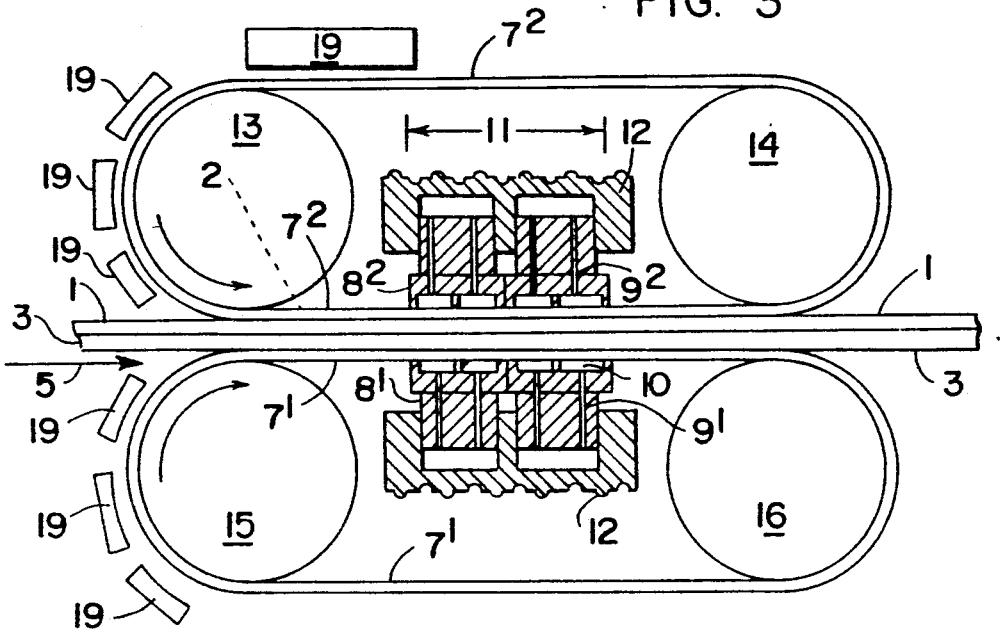
FIG. 3 illustrates a third exemplary embodiment of the inventive dewatering apparatus, partially in sectional view, suitable for the practice of the inventive mechanical-thermal dewatering method.

Describing now the drawings, it is to be understood that to simplify the showing thereof, only enough of the structure of the apparatus for the mechanical-thermal dewatering of a water-containing fibrous web, typically a paper web, has been illustrated therein as needed to enable one skilled in the art to readily understand the underlying principles and concepts of this invention.

Turning attention now specifically to the exemplary embodiment of apparatus, as schematically depicted in FIG. 1, and suitable for carrying out a first exemplary embodiment of the inventive method, it will be understood that at such apparatus, defining a pressing apparatus for the water-containing fibrous or fiber web 1, typically for instance, a paper web, there is accomplished a mechanical-thermal dewatering of the fiber web 1. This mechanical-thermal dewatering of the fibrous web 1 is performed by simultaneous utilization of both pressure and thermal energy or heat at a press or pressing nip 2 in an extended pressing zone 4 through which the fibrous web 1 to be dewatered is guided or passed in conjunction with a porous or foraminous band or belt 3, typically a felt, suitable for the pick-up or absorption of water which has been expelled or forced out of the fibrous web 1. Due to the simultaneous application of pressure and heat there can be increased the quantity of water displaced from the fibrous web 1 and taken up by the porous or foraminous belt 3.

The dewatering operation is undertaken in the extended or long pressing zone 4 having a length indicated generally by the double-headed arrow. In the embodiment under discussion the extended pressing zone 4 is formed . between coacting elements or members, here a heated substantially cylindrical counter roll 6 having, for instance, a solid surface and an impervious band or belt 7 which, as stated, may be constituted not only by a band or belt structure but also by a hollow shell or jacket, as is well known in this technology. This band 7 is pressed in the direction of the counter roll 6 by means of suitable contact pressure devices, here shown as pressing or pressure or support elements 8 or 9. A plurality of pressing or pressure elements 8 or 9 are arranged in respective substantially parallel rows in the machine cross-width direction and each row defines a discrete region or section of the extended pressing zone 4 with respect to the direction of travel, generally indicated by the arrow 5, of the fibrous web 1 and the porous band 3. An intermediate seal arrangement 20 or equivalent structure is provided between the pressing or pressure elements 8 and 9 of immediately consecutive rows. The different rows of pressure elements 8 and 9 are thus arranged immediately consecutive but in sealed relationship to each other. As a result of this construction, the discrete region or sections of the extended pressing zone 4 merge with each other without any spacing therebetween so that the fibrous web 1 passes from one discrete region or section to the next without interruption whereas the pressures prevailing in different discrete regions or sections can be independently selected or adjusted or, if desired, regulated because there is no pressure fluid communication therebetween.

Such pressure or support elements are well known in the art, as exemplified, for instance, by the commonly assigned U.S. Pat. No. 4,556,454, granted Dec. 3, 1985, U.S. Pat. No. 4,570,314, granted Feb. 18, 1986 and U.S. Pat. No. 4,661,206, granted Apr. 28, 1987, to which reference may be readily had.

In FIG. 1A there has been shown one example of a pressure variation, i.e. curve or profile 21 along the extended pressing zone 4. As a matter of simplification in the illustration of the drawings, only two pressure elements 8 and 9 or equivalent structure have been shown, although the arrangement is, as previously described, preferably composed of transversely extending substantially parallel rows of such pressure elements 8 and 9 which also successively extend in the direction of travel 5 of the throughpassing fibrous web 1.

As will be further explained hereinafter, thermal energy or heat is infed to the fibrous web 1 as it travels through the extended pressing zone 4. At the same time, within the first section of the extended pressing zone 4, the fibrous web 1 is exposed to the relatively high pressure indicated in the first section of the pressure profile 21 shown in FIG. 1A. This pressure is sufficiently high to compress the fibrous web to such degree that there is obtained substantially complete saturation of the voids, pores and capillaries of the fibrous web 1 with the the liquid water present in the fibrous web 1. Additionally, there is applied hydraulic pressure to a level such that the applied total pressure is substantially above the equilibrium vapor pressure of the water contained in the fibrous web 1 under the temperature conditions prevailing in this first section of the extended pressing zone 4. Consequently, no water vapor or steam is formed in this first section and a first portion of water is "squeezed out" from the fibrous web under the compressive action of the pressure elements 8 and received or absorbed by the porous or foraminous band 3.

A second section or region of the extended pressing zone 4 is defined at the region of the pressure elements 9 and prior to the departure of the fibrous web 1 out of the extended pressing zone 4. The treatment pressure exerted at the fibrous web 1 by means of the pressure elements 9 is appreciably reduced in relation to the pressure prevailing in the preceding first section or region of the extended pressing zone 4, as indicated by the second section of the pressure profile 21 shown in FIG. 1A.

Under the temperature conditions prevailing in this second section of the extended pressing zone 4, the effective pressure is at zero hydraulic pressure and below the equilibrium vapor pressure of the water still contained in the fibrous web 1 after passage through the first section. Consequently, water vapor or steam is formed in the region in which the fibrous web 1 contacts the heated counter roll 6 and, due to the substantial volume increase as compared to the related amount of liquid water prior to evaporation, the thus formed water vapor or steam very effectively displaces or expels the remaining portion of liquid water from the fibrous web 1 into the porous or foraminous band 3. Additionally, further water which adheres to the fibers of the fibrous web 1, also may be vaporized and condensed in the lower temperature regions, i.e. at the porous or foraminous band 3.

The fibrous web 1 thus is free of coherent drops or pockets of liquid water when leaving the extended pressing zone 4. The risk of damage to the fibrous web due to flash or explosive evaporation of such drops or pockets of liquid water thus is reliably avoided. The pressure reductions in the stages of the dewatering process, i.e. in the consecutive sections of the extended pressing zone 4 are also such that undesirable flash or explosive evaporations are safely excluded.

During fabrication of certain types of paper, where there is desired the attainment of a predeterminate paper web thickness following the extended pressing zone 4, there is utilized a so-called volume effect, which means that the pressure in the second section of the extended pressing zone 4, prior to the departure of the fibrous or paper web 1 out of such second section or portion of the extended pressing zone 4, is not completely reduced to ambient pressure. Instead, the pressure is regulated such that it is slightly above ambient pressure.

This leads to the beneficial result that, due to the further evaporation of water from the fibrous web 1 as a result of the small pressure drop to ambient pressure upon exit of the fibrous web 1 from the extended pressing zone 4, there can be adjusted or set a desired thickness of the fibrous or paper web 1 which is greater than the web thickness which prevails in the compressed state of the web 1 within the extended pressing zone 4. Moreover, this measure beneficially also prevents rewetting of the outgoing or outbound fibrous or paper web 1 due to moisture re-entering the fibrous or paper web 1 from the porous band or felt 3.

According to the embodiment depicted in FIG. 1 of the drawings, and this is also true for the other embodiments, the pressure elements 8 and 9 have been shown as hydrostatic pressure or support elements containing pressure or bearing pockets 10 which can be impinged with a suitable pressurized fluid medium, typically oil. These pressure or bearing pockets 10 are open in the direction of the impervious band 7 or the like. Such pressure or bearing pockets 10 can have equal size surfaces or cross-sectional areas which confront the moving impervious band 7. However, as shown for the modified construction depicted in FIG. 2, the pressure or bearing pockets, designated in such FIG. 2 by reference characters 101 and 102, of the pressure or support elements 83 also can have pressure or bearing pockets of different size or cross-sectional area. In FIG. 2A there has likewise been depicted the associated pressure profile or curve 21' showing the variation of the treatment or processing pressure applied to the fibrous web 1 during its travel through the extended pressing zone 4.

In the embodiment of FIG. 1 the pressure or support elements 8 or 9 are each supported or carried at a support or beam 12 or equivalent structure which provide the cylinder chambers or cylinders 8*a* and 9*a* for the associated pressure or support elements 8 and 9, respectively. The pressurized fluid medium can be infed through related infeed lines or conduits 8*b* and 9*b* to the related cylinder chambers or cylinders 8*a* and 9*a* and such pressurized fluid medium then flows through the throttle bores or channels 8*c* and 9*c* to the associated pressure or bearing pockets 10, as is well known in this technology. In the arrangement of FIG. 2 each of the pressure elements $8^3$ is likewise supported or mounted at the related support or beam 12 in an associated cylinder chamber or cylinder 30 to which the pressurized fluid medium is likewise infed through a suitable infeed line or conduit (not shown) and then flows, via the throttle bores or : channels 32 and 34, to the related pressure or bearing pockets $10^1$ and $10^2$.

By means of the pressure elements 8 and 9 having the same size pressure or bearing pockets 10 (FIG. 1) or the pressure elements $8^3$ having different size pressure or bearing pockets $10^1$ and $10^2$ (FIG. 2), it is not only possible to mechanically obtain an appropriate contact pressure or pressing action in the extended pressing zone 4, but it is also possible, by means of the infed pressurized fluid medium, which can be appropriately tempered or conditioned, to heat or to cool the throughpassing impervious band 7 or the like in order to thereby affect the temperature conditions of the fibrous web 1 and the porous band or felt 3 passing through the extended pressing zone 4 along with the impervious band 7. Accordingly, it is advantageous to thus use for the throughpassing band 7 or the like a metallic band or to use another suitable temperature-resistant material.

It is also possible to set or regulate at desired sections or regions of the extended pressing zone 4 not only the pressure but also the temperature. The infeed of thermal energy or heat can be effected, for example, by one or more heating devices or heaters 17 which can be located within the substantially cylindrical counter roll 6. Also, heating devices or heaters 18 can be arranged externally of the cylindrical counter roll 6, as depicted in FIG. 1. If desired, both internal and external heating means of various types can be used in conjunction with the counter roll 6. Such heaters 17 and 18 may be constructed, for example, as inductive heaters or gas heaters.

Additional heating devices, especially additional heating devices 19 as depicted in FIG. 1, can be beneficially used to also heat the fibrous or paper web 1, the porous or foraminous band 3, and/or the impervious band 7. Various types of additional heating devices 19 may be used such as, for instance, inductive heaters or gas heaters.

A third exemplary embodiment of the inventive apparatus has been shown in FIG. 3 and is likewise suitable for carrying out the inventive method. Here the dewatering operation is accomplished in an extended pressing zone 11. This extended pressing zone 11 is formed in this embodiment between two coacting elements or members in the form of two revolving endless impervious bands or belts $7^1$ and $7^2$ which extend essentially parallel to one another. These endless revolving bands or belts $7^1$ and $7^2$ are trained about respective guide rolls or rollers 15, 16 and 13, 14 wherein the rolls 13 and 15 may be appropriately driven rolls or rollers. In the space between each pair of rolls, such as the rolls 13 and 14 about which there is trained the endless band or belt $7^2$ and equally in the space between the other pair of rolls 15 and 16 about which there is trained the other endless band or belt $7^1$, there are arranged, as shown, on both sides of the extended pressing zone 11 respective pressing or pressure or support elements $8^1$, $9^1$ and $8^2$, $9^2$.

The aforedescribed pressure or support elements $8^1$ $8^2$, $9^1$ and $9^2$ can be pressed towards one another and the respective revolving impervious bands $7^1$ and $7^2$, so that a desired controlled pressure profile can be regulated or adjusted in the extended pressing zone 11. Just as was previously the case, here also these pressure elements $*^1$, $9^1$ and $8^2$, $9^2$ are supported by respective supports or beams 12, as shown in FIG. 3. Moreover, these pressure or support elements $8^1$, $8^2$, $9^1$ and $9^2$ are shown to be constituted by hydrostatic pressure or support elements which can be impinged, like for instance as explained for the arrangement of FIG. 1, with a suitable pressurized fluid medium, as is well known in this technology. Again it will be observed that pressure or bearing pockets 10 are provided for these pressure elements $8^1$, $8^2$, $9^1$ and $9^2$ and confront the related revolving impervious bands $7^1$ and $7^2$. Moreover, it is advantageous if at least certain of the pressure elements, such as for instance the pressure elements $8^1$ and $9^1$, which are operatively associated with one of the bands, here the revolving impervious band $7^1$, have applied thereto an appropriately tempered or conditioned pressurized fluid medium for cooling the revolving impervious band $7^1$ moving past the hydrostatic pressure or support elements $8^1$ and $9^1$. Since the upper hydrostatic pressure elements $8^2$ and $9^2$ can be impinged with an appropriately tempered or conditioned medium serving for heating purposes, it is possible to introduce the requisite thermal energy or heat at the extended pressing zone 11. In this case as well as in the aforedescribed embodiments an appropriately selected thermal oil serves as the heat carrier medium as well as the pressurized fluid medium. Consequently, a temperature gradient is formed in the fibrous or paper web 1 and the porous band 3 travelling between the upper revolving impervious band $7^2$ and the lower revolving impervious band $7^1$ which augments displacement or removal of water from the fibrous web 1.

Figure 4:
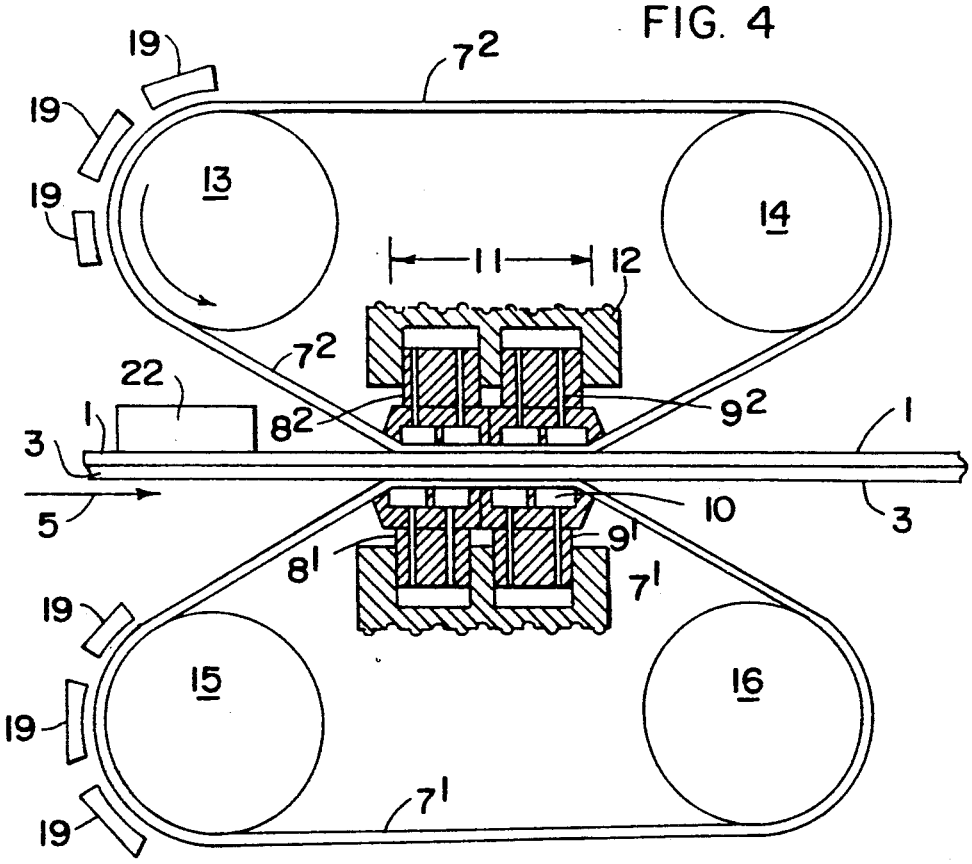
FIG. 4 illustrates a fourth exemplary embodiment of the inventive dewatering apparatus, again partially in sectional view, for the mechanical-thermal dewatering of a fibrous web.

A desired one of the revolving impervious bands, here the band $7^2$ is heated by means of various types of heating devices or heaters 19 as depicted in FIGS. 3 and 4. Such heating devices 19 may constitute, for example, inductive heaters or gas heaters. Similar or equivalent measures can be usefully provided, if desired, for additionally heating the fibrous web 1 as well as the pervious or foraminous band 3. For additional cooling there can be provided, in similar fashion, suitable cooling devices.

FIG. 4 illustrates a press structure or arrangement quite similar to the apparatus shown in FIG. 3 wherein, however, the coacting roll pairs 13, 14 and 15, 16 are somewhat differently arranged so that the associated revolving impervious bands $7^2$ and $7^1$ move along the illustrated different paths of travel. There is also shown a further heating element 22 for heating the incoming fibrous or paper web 1.

In the embodiments of FIGS. 3 and 4 the infeed of the pressurized fluid medium to the cylinder chambers or cylinders and then through the throttle bores of the pressure or support elements $8^1$, $8^2$, $9^1$ and $9^2$ into the corresponding : pressure or bearing pockets 10 is accomplished, for instance, in the manner already described previously with respect to the embodiment of FIG. 1, and thus need not be here again further considered.

In the following, further embodiments of the inventive method will be described with reference to constructions related to the embodiments illustrated in FIGS. 1 and 2. It will be understood, however, that the following explanations are correspondingly applicable to constructions of the type as described hereinbefore with reference to FIGS. 3 and 4.

A modification of the first exemplary embodiment of the inventive method described hereinbefore with reference to FIGS. 1 and 2 consists in applying in the first section of the extended pressing zone 4 to the fibrous web as it passes through the extended pressing zone 4, a pressure which is sufficient to substantially completely saturate the voids, pores and capillaries of the fibrous web 1 with the liquid water which is contained in the fibrous web 1, and applying beyond that "saturation" pressure a hydraulic pressure but such that the prevailing total pressure does not exceed the equilibrium vapor pressure of the water contained in the fibrous web 1 under the temperature conditions prevailing in the first section of the extended pressing zone 4. , Consequently, some of the water contained in the fibrous web 1 is vaporized in the region where the fibrous web 1 contacts the heated counter roll 6. The thus formed water vapor or steam, due to the concomitant volume increase effected by the vaporization, acts to additionally expel or displace water from the fibrous web 1 into the water-absorbing porous or foraminous band or felt web 3 whereby there is augmented the squeezing action of the hydraulic pressure upon the fibrous web 1 in the first section of the extended pressing zone 4. The amount of water, i.e. The first portion of water expelled or displaced from the fibrous or fiber web, is thereby increased.

This particular modification of the first exemplary embodiment of the inventive method thus utilizes already part of the heat supplied by the counter roll 6 to vaporize the liquid water which is contained in the fibrous web 1 for expelling or displacing such liquid water from the water containing fibrous web 1. This modification, therefore, would appear advantageous over the aforedescribed first exemplary embodiment of the inventive method because the available thermal energy of heat is utilized in the first section as well as the second section of the extended pressing zone 4. However, the heat which is utilized in the first section is not available in the second section of the extended pressing zone 4 and thus this modification can only be used successfully if the total amount of heat supplied by the counter roll 6 is sufficient for the overall dewatering process.

This is also true when, as described further hereinabove, both heating means or heaters 17 and 18 are used in conjunction with the counter roll 6 and the additional heating means or heaters 19 are employed for preheating the fibrous web 1 and/or the porous or foraminous band or felt web 3 and/or the impervious band 7 precedingly of the pressing zone 4 as viewed in the travel direction of the fibrous web 1. It should be noted, however, that the heat requirements of the dewatering process are dependent upon the water or moisture content of the fibrous web 1 and on the type of fibrous web 1 which passes through the dewatering apparatus so that, depending thereupon, the aforedescribed modification of the first exemplary embodiment of the inventive method may be employed for carrying out the dewatering operation in suitable cases.

Figure 5A:
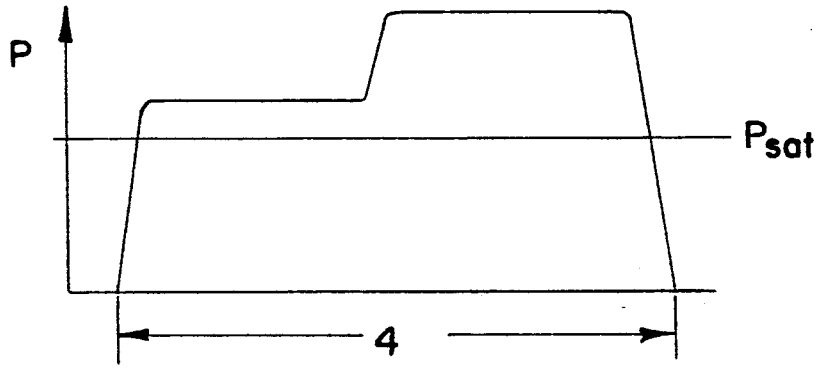
FIG. 5A shows a pressure profile along the extended pressing zone when carrying out a second exemplary embodiment of the inventive method using the apparatus shown in FIG. 5.
Figure 5:
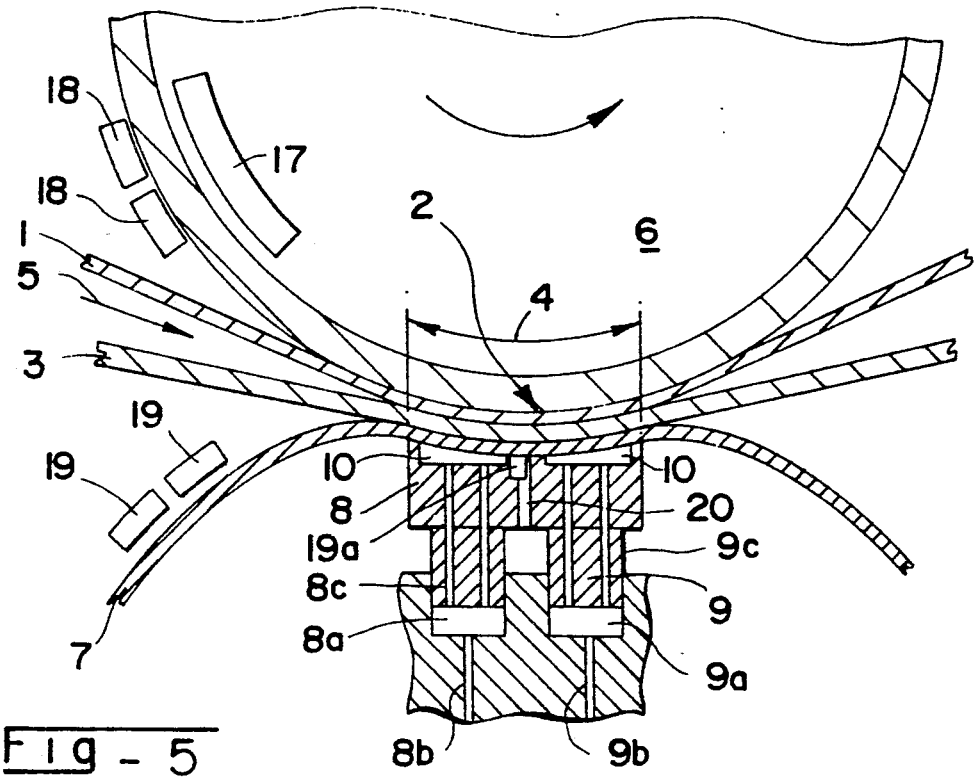

A fifth exemplary embodiment of the inventive apparatus for mechanical-thermal dewatering of a water-containing fibrous web or the like is schematically illustrated in a fragmentary sectional view in FIG. 5 of the drawings in the instant application. The apparatus illustrated in FIG. 5 is basically constructed in the same manner as the first exemplary embodiment as illustrated in FIG. 1 of the drawings, and therefore, identical reference characters have been generally used to designate the corresponding components in FIG. 5.

This fifth exemplary embodiment of the inventive apparatus differs from the apparatus shown in FIG. 1 by the presence of heating means, particularly inductive heating means 19*a* which are installed in order to overcome the aforementioned heat loss problems and to ensure that sufficient thermal energy or heat is available for accomplishing the desired extent of vaporization of water as the fibrous web 1 passes through the second section of the extended pressing zone 4. As illustrated, the additional, particularly inductive heating means 19*a* are located in the end region of the first section of the extended pressing zone 4. The use of the inductive heating means 19*a* in conjunction with a counter roll 6 which is made of an appropriately selected material, has the highly beneficial and desirable effect that the additional heat is supplied specifically in that contact region of the counter roll 6 where the aforementioned heat loss occurs and thus the inductive heat supply is most effective. It will be appreciated, however, that the inductive heating means 19*a* can be placed at different locations is such different locations are desirable. Thus, for example, the inductive heating means 19*a* may also be located in the transition region between the first section and the second section of the extended pressing zone 4 or may even be placed at the input or inlet region of the second section of the extended pressing zone 4. Furthermore, the inductive heating means 19*a* may also be located on the inside of the counter roll 6 at an appropriately selected location for effecting the desired heat supply to the contact surface of the counter roll 6 and which contact surface is in contact with the water containing fibrous web 1 passing through the extended pressing zone 4.

When utilizing the construction containing the additional, particularly inductive heating means 19*a* or any other suitable heating means providing the desired localized heat supply to the counter roll 6, the problems can be overcome which arise due to excessive heat losses in the extended pressing zone 4 when carrying out the aforedescribed first exemplary embodiment of the inventive method or the aforementioned modification thereof.

The construction shown in FIG. 5, however, is particularly useful for realizing a second exemplary embodiment of the inventive method which will now be explained with reference to FIG. 5A which shows the pressure profile prevailing in the extended pressing zone 4 when carrying out such second exemplary embodiment of the inventive method. As illustrated, the pressure applied in the first section of the extended pressing zone 4, is higher than the saturation pressure $P_{sat}$ required to substantially completely saturate or fill the voids, pores and capillaries of the fibrous web 1 with the liquid water which is contained in the fibrous web 1. In fact, the applied pressure exceeds such saturation pressure $P_{sat}$ to some degree but nevertheless is below the equilibrium vapor pressure of the water contained in the fibrous web 1. Consequently, the water which is present in the fibrous web 1 in those regions which contact the counter roll 6, is vaporized and, due to the concomitant volume increase, the liquid water is expelled or displaced in the direction of the porous or foraminous or felt web 3. Thus, this second exemplary embodiment of the inventive method also relies upon the combined effects of "squeezing" under the action of the applied hydraulic pressure to the fibrous web and upon the "displacement" effect of water vapor or steam formation to expel an increased first portion of water from the water containing fibrous web 1 which enters and passes through the first section of the extended pressing zone 4. Although a substantial amount of water is displaced from the fibrous web 1 in the first section, the displacement is not complete due to condensation of the water vapor or steam within the fibrous web 1 in the regions remote from the contact surface of the counter roll 6 and due to the heat loss from the counter roll 6.

The heat loss is at least partially replaced and, if desired, even more heat can be supplied by means of the inductive heating means 19*a* or the like in a manner such that sufficient heat is available during throughpassage of the water containing fibrous web 1 through the second section of the extended pressing zone 4.

However, due to the significant vaporization in the first section of the extended pressing zone 4, the fibrous web 1 is no longer saturated with water after passing through the first section of the extended nipping zone 4. In order to ensure substantially complete saturation or filling of the voids, pores and capillaries in the fibrous web 1 with the remaining water which is still contained therein after passage through the first section of the extended pressing zone 4, increased pressure is applied to the fibrous web 1 in the second section of the extended pressing zone 4. The pressure is increased to the saturation pressure $P_{sat}$ which is required in the second section and may even be substantially increased depending on the degree of water displacement from the fibrous web 1 in the first section of the extended pressing zone 4.

In any event, however, the pressure which is applied to the fibrous web 1 during passage through the second section, is lower than the equilibrium vapor pressure of the water contained in the fibrous web 1 under the temperature conditions prevailing in the second section of the extended pressing zone 4. This condition can be readily realized due to the presence of the inductive heating means 19*a* or the like. In fact, the pressure and temperature conditions are selected such that at least the remaining portion of liquid water is expelled or displaced from the fibrous web 1 into the porous or foraminous band or felt web 3 under the action of the water vapor or steam which is formed due to the contact of the fibrous web 1 with the heated counter roll 6. This effect, of course, can be additionally augmented by applying additional hydraulic pressure to the fibrous web, if possible.

Furthermore, due to the pressure and temperature conditions prevailing in the second section of the extended pressing zone 4; not only the remaining portion of liquid water is expelled or displaced from the fibrous web 1 but additionally substantial amounts of the water adhering to the fibers of the fibrous web 1 is vaporized and removed from the fibrous web due to the flow direction of water vapor or steam to the fibrous or foraminous and/or felt web 3 at which the water vapor or steam is condensed. Further amounts of such fiber-adhered water will be removed once the fibrous web 1 departs or exits from the extended pressing zone 4 due to the pressure drop to ambient pressure.

When carrying out the aforedescribed second exemplary embodiment of the inventive method, the higher pressure which is applied to the fibrous web 1 during its passage through the second section of the extended pressing zone 4, must not be sufficient to excessively compress the fibrous web 1, as already explained hereinbefore, in order to avoid over-compression which results in a detrimental effect upon the mechanical properties of the fibrous web. Due to the relatively high pressure which is applied to the fibrous web 1 during its passage through the second section of the extended pressing zone 4, there results a correspondingly high pressure drop to ambient pressure at the moment at which the heated fibrous web 1 departs or exits from the extended pressing zone 4. Therefore, it must be ensured that the concomitant vaporization of any remaining water contained in the fibrous web 1 in the end region of the second section of the extended pressing zone 4, does not lead to web damage due to flash or explosive vaporization. However, the pressure and temperature conditions prevailing within the first and second sections of the extended pressing zone 4 can be , appropriately controlled and selected such as to dewater the fibrous web 1 during its passage through the extended pressing zone 4 to an extent which will safely preclude such flash or explosive evaporation damage to the fibrous web 1 upon exit or departure from the extended pressing zone 4.

Figure 6A:
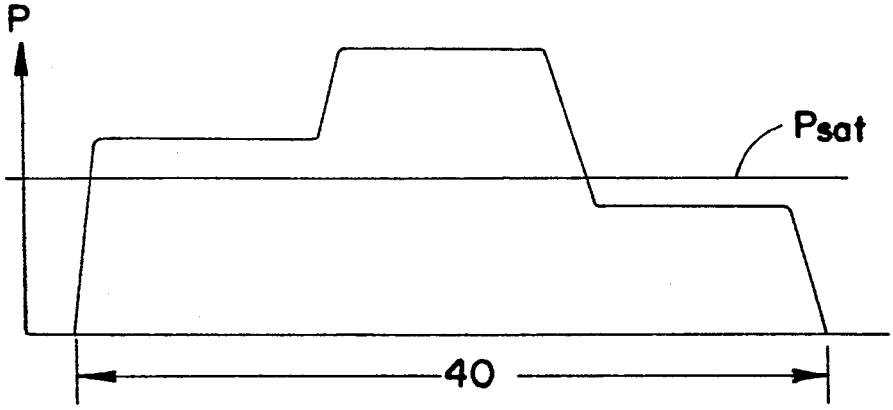
FIG. 6A shows a pressure profile or curve along the extended pressing zone when carrying out a third exemplary embodiment of the inventive method using the apparatus shown in FIG. 6.
Figure 6:
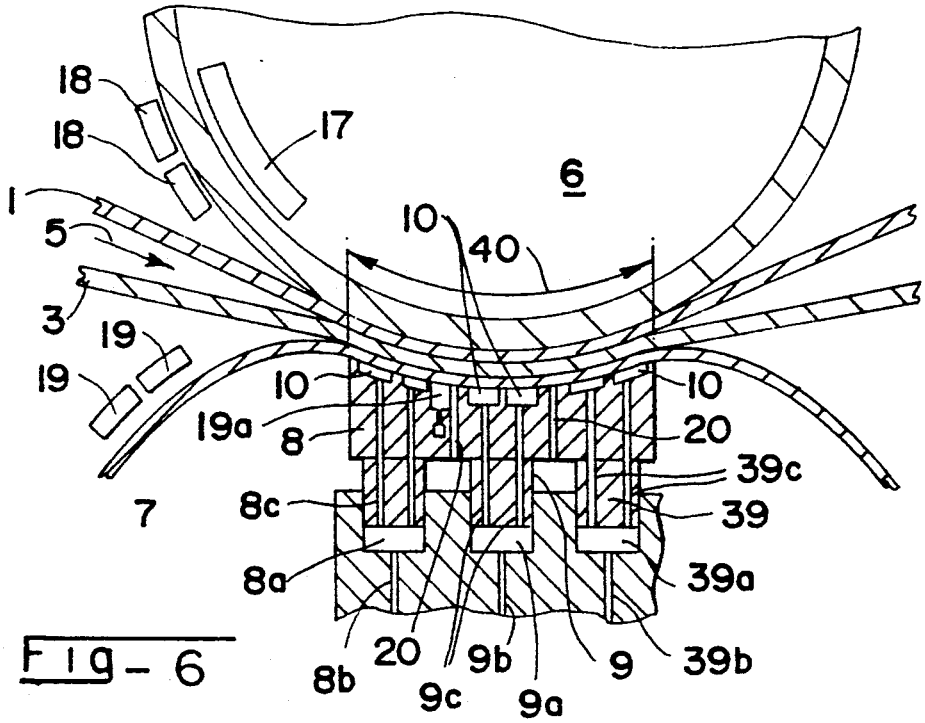

In order to permit still further control of the dewatering process, a sixth exemplary embodiment of the inventive apparatus is constructed in the manner as illustrated in FIG. 6 of the drawings. The illustration is a fragmentary sectional view substantially corresponding to the illustration of FIGS. 1 and 5 and the corresponding components have been designated by the same reference characters. Thus, the sixth exemplary embodiment of the inventive apparatus contains all of the components described hereinbefore with reference to FIG. 5 and required for producing the first and second sections of an extended pressing zone 40 inclusive of the various aforediscussed means, particularly the inductive heating means 19*a* or the likc. Additionally, the third exemplary embodiment of the inventive apparatus contains a third row of pressure or support elements 39 which substantially correspond to the pressure or support elements 9 which define the second section of the extended pressing zone 4. This third row of pressure or support elements 39 extends substantially parallel to the second row of pressure or support elements 9 and is separated therefrom only by means of the aforementioned intermediate seal arrangement 20 or equivalent structure. Consequently, the third row of pressure or support elements 39 is arranged immediately consecutive and in sealed relationship to the second row of pressure or support elements 9 so that there is no pressure fluid communication between the pressure or support elements 9 and 39 although these two pressure or support elements 9 and 39 substantially immediately follow each other. The pressure or support elements 39 thus define a third section of the extended pressing zone 40 and this third section is immediately consecutive to but separate from the second 1 section of the extended pressing zone 40. There is thus an uninterrupted transition from the second section to the third section but the pressure conditions prevailing in the third section can be selected or adjusted independently of the pressure conditions prevailing in the second section.

The individual pressure or support elements 39 are constructed substantially in correspondence with the aforedescribed pressure or support elements 8 and 9. Thus, each pressure or support element 39 contains a pressure or bearing pocket 10 which is open in the direction of the impervious band 7 or the like and may have either equally or differently sized surfaces or cross-sectional areas which confront the moving impervious band 7 and which are constructed or selected in accordance with the requirements. Each one of the support elements 39 is carried at the support or beam 12 or equivalent structure which also supports or carries the pressure or support elements 8 and 9. Cylinder chambers or cylinders **39*a* are provided for each pressure or support element 39 in such support or beam 12 and the pressurized fluid medium is infed to the cylinder chamber or cylinder 39*a* through an infeed line or conduit 39*b*. Throttle bores or channels 39*c* in each pressure or support element 39 provide pressurized fluid communication between the bearing pockets 10 and the cylinder chamber or cylinder 39*a***.

In this third exemplary embodiment, additional heating means such as the heating means, particularly inductive heating means **19*a* or the like may also be provided in the region of the second or third sections of the extended pressing zone 40**, if required.

A third exemplary embodiment of the inventive method will now be described with reference to FIG. 6A which shows a pressure profile illustrative of the pressure variation along the extended pressing zone 40 provided in the sixth exemplary embodiment of the inventive apparatus illustrated in FIG. 6. Reference is made to the foregoing description of the pressure profile shown in FIG. 5A because the pressure profile above the saturation pressure $P_{sat}$ in the first and second section of the extended pressing zone 40 substantially corresponds to the pressure conditions prevailing in the extended pressing zone 4 when carrying out the second exemplary embodiment of the inventive method. As explained in detail hereinbefore, the heating means, particularly inductive heating means **19*a* or the like permit vaporization of the water contained in the fibrous web 1 already during passage thereof through the first section; a corresponding pressure increase is provided in the second section in order to re-establish saturation of the voids, pores and capillaries with water as the fibrous web 1 enters and passes through the second section of the extended pressing zone 40**.

In order to avoid the aforementioned risks of overcompression of the fibrous web 1 as well as the comparatively high pressure drop to ambient pressure upon departure from the extended pressing zone 40, the third section is provided in the extended pressing zone 40. The pressure prevailing in this third section is significantly reduced in comparison to the pressure prevailing in the second section and, as illustrated, may even be lower than the saturation pressure $P_{sat}$ but is still above atmospheric or ambient pressure. Under the pressure and temperature conditions prevailing in the third section, still further amounts of water, particularly water adhered to the fibers of the fibrous web 1, are vaporized and expelled from the fibrous web 1 to the water absorbing water porous or foraminous band or felt web 3. Due to the pressure reduction, a controlled expansion of the fibrous web 1 is rendered possible in the third section of the extended pressing zone 40 and thus, by the provision of the third section of the extended pressing zone 40, there can be realized also in the third exemplary embodiment of the inventive method the beneficial effects and advantages of a controlled pressure reduction on the outlet side of the extended pressing zone, as described hereinbefore with reference to FIG. 1 of the drawings.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of mechanical-thermal dewatering a water containing fibrous web using the simultaneous application of pressure and heat, comprising the steps of:

passing a water containing fibrous web to be dewatered together with a porous band for taking up water which is displaced from the fibrous web, through an extended pressing zone in a predetermined travel direction;

arranging at least two substantially parallel rows of adjustable pressure elements immediately consecutive but in sealed relationship to each other as viewed in said predetermined travel direction of said fibrous web, in cooperative relationship with a counter element and thereby forming at least two immediately consecutive but separate pressing sections of said extended pressing zone, each row extending transversely to the predetermined travel direction of the fibrous web;

adjusting the pressure generated by said adjustable pressure elements of said at least two substantially parallel rows of adjustable pressure elements, for producing predeterminate pressure conditions in said at least two immediately consecutive but separate pressing sections of said extended pressing zone;

heating said counter element and contacting the heated counter element and the fibrous web during its passage through the extended pressing zone and thereby establishing predeterminate temperature conditions in said at least two immediately consecutive but separate pressing section of said extended pressing zone;

applying, but adjusting the pressure generated by the respective adjustable pressure elements, tot he fibrous web in at least one of said at least two immediately consecutive but separate pressing sections of said extended pressing zone, a pressure sufficient to substantially completely saturate voids, pores and capillaries of the fibrous web with liquid water contained in said fibrous web and to build up hydraulic pressure in order to thereby displace a first portion of liquid water form the fibrous web into said porous band;

applying, by adjusting the pressure generated by the respective adjustable pressure elements, to the fibrous web in a further one of said at least two immediately consecutive but separate pressing sections of said extended pressing zone, a preselected pressure which is lower than the equilibrium vapor pressure of the water contained in the fibrous web, in order to vaporize part of said water contained in the fibrous web under the temperature conditions prevailing in said further pressing section of said extended pressing zone and to thereby displace a second portion of walter form said fibrous web into said porous band; and displacing at least substantially all of the liquid water from said fibrous web prior to reducing the pressure acting upon said fibrous web to ambient pressure in order to thereby prevent web-damaging flash evaporation of liquid water as a result of the pressure reduction under the prevailing temperature conditions.

2. The method as defined in claim 1, wherein:

said step of forming said at least two immediately consecutive but separate pressing sections of said extended pressing zone, entails arranging two substantially parallel , rows of pressure-fluid adjustable pressure elements and thereby forming, as said at least two immediately consecutive but separate pressing sections of said extended pressing zone, a first pressing section and a second pressing section which define the extended pressing zone and immediately follow each other in said predetermined travel direction of said fibrous web.

3. The method as defined in claim 2, wherein:

said step of building up hydraulic pressure in said at least one pressing section entails adjusting a predeterminate hydraulic pressure level in said first pressing section of said extended pressing pressing zone;

during said step of adjusting said predeterminate hydraulic pressure level in said at least one pressing section of said extended pressing zone, adjusting said predeterminate hydraulic pressure level to a total pressure level above the equilibrium vapor pressure of the water contained in the fibrous web under the temperature conditions prevailing in said first pressing section;

during said step of displacing said first portion of water, displacing said first portion of water from said first pressing section substantially under the action of said total pressure level; and said step of applying said preselected pressure in said further pressing section of said at least two immediately consecutive but separate pressing sections of said extended pressing zone, entailing the step of adjusting a reduced pressure level in said second pressing section of said extended pressing zone as compared to the total pressure level prevailing in said first pressing section.

4. The method as defined in claim 3, wherein:

said step of applying said reduced pressure level to said fibrous web in said second pressing section of said extended pressing zone, includes reducing the pressure to a pressure level slightly above ambient pressure.

5. The method as defined in claim 4, further including the step of:

further reducing the pressure level prevailing in said second pressing section of said extended pressing zone to ambient pressure within an exit region of said second pressing section in order to prevent uncontrolled expansion of the fibrous web upon pressure reduction to ambient pressure.

6. The method as defined in claim 1, further including the step of:

preheating the fibrous web prior to entry into the extended pressing zone.

7. The method as defined in claim 1, further including the step of:

preheating the porous band prior to entry into the extended pressing zone.

8. The method as defined in claim 1, further including the steps of:

guiding an impervious band conjointly with the fibrous web and the porous band through said extended pressing zone; and applying to said impervious band, said pressure generated by said adjustable pressure elements.

9. The method as defined in claim 8, further including the step of:

preheating said impervious band prior to entry into the extended pressing zone.

10. The method as defined in claim 1, further including the steps of:

guiding an impervious band on each one of the opposite sides of the combined fibrous web and porous band conjointly with the fibrous web and the porous band through said extended pressing zone; and preheating the fibrous web upstream of the extended pressing zone between said impervious bands.

11. The method as defined in claim 1, wherein:

said step of heating said counter element entails heating said counter element in a predeterminate region preceding said extended pressing zone.

12. The method as defined in claim 11, further including the step of:

additionally heating the counter element within the extended pressing zone.

13. The method as defined in claim 12, wherein:

said step of additionally heating said counter element within said extended pressing zone, entails inductively heating said counter element in at least one predetermined region of said extended pressing zone.

14. The method as defined in claim 13, wherein:

said step of inductively heating said counter element in said at least one predetermined region of said extended pressing zone, includes inductively heating said counter element at least in a transition region defined between said at least two immediately consecutive but separate pressing sections of said extended pressing zone.

15. The method as defined in claim 13, wherein:

said step of inductively heating said counter element in said at least one predetermined region of said extended pressing zone, includes the step of inductively heating said counter element in an end region of said first pressing section as viewed in the predetermined travel direction of said fibrous web.

16. The method as defined in claim 15, wherein:

said step of building up hydraulic pressure in said at least one pressing section of said extended pressing zone, entails adjusting a predeterminate hydraulic pressure level in said first pressing section of said extended pressing zone;

during said step of adjusting said predeterminate hydraulic pressure level in said first pressing section, adjusting the hydraulic pressure level to a total pressure level below the equilibrium vapor pressure of the water contained in the fibrous web under the temperature conditions prevailing in said first pressing section and thereby vaporizing part of the water contained in the fibrous web;

during said step of displacing said first portion of water, displacing said first portion of water from the fibrous web under the combined action of said total pressure level and the water vapor formed by vaporizing said part of the water contained in the fibrous web; and said step of applying said preselected pressure to the fibrous web in said second pressing section of said extended pressing zone, entailing the step of adjusting in said second pressing section, relative to said pressure level prevailing in said first pressing section, an increased pressure level sufficient for substantially completely saturating said voids, pores and capillaries of the fibrous web with the water remaining in the fibrous web after displacement of said first portion of water from the fibrous web in said first pressing section of said extended pressing zone, but lower than the equilibrium vapor pressure of said remaining water in the fibrous web under the temperature conditions prevailing in said second pressing section of the extended pressing zone after additionally inductively heating said counter element in said end region of said first pressing section of the extended pressing zone.

17. The method as defined as claim 16, further including the steps of:

arranging a third row of adjustable pressure elements substantially parallel to said two rows of adjustable pressure elements and thereby forming a third pressing section immediately following said second pressing section of said extended pressing zone; and 1, applying to said third pressing section of said extended pressing zone, a predeterminate pressure level lower than said increased pressure level prevailing in said second pressing section of said extended pressing zone but exceeding ambient pressure.

* * * * *